US005434580A

United States Patent [19]

Raguenet et al.

[11] Patent Number: 5,434,580

[45] Date of Patent: Jul. 18, 1995

[54] MULTIFREQUENCY ARRAY WITH COMPOSITE RADIATORS

[75] Inventors: Gérard Raguenet, Portet sur Garonne; Régis Lenormand, Blagnac; Michel Gomez-Henry, Toulouse; Alain Gergondey, Plaisance du Touch, all of France

[73] Assignee: Alcatel Espace, Courbevoie, France

[21] Appl. No.: 17,451

[22] Filed: Feb. 12, 1993

Related U.S. Application Data

[63] Continuation of Ser. No. 670,514, Mar. 18, 1991, abandoned, which is a continuation of Ser. No. 445,063, Dec. 4, 1989, abandoned.

[30] Foreign Application Priority Data

Dec. 8, 1988 [FR] France ..... 88 16140

[51] Int. Cl.[6] ..... H01Q 5/01; H01Q 21/28

[52] U.S. Cl. ..... 343/700 MS; 343/725

[58] Field of Search ..... 343/725, 729, 700 MS, 343/810, 893; H01Q 21/00, 5/00, 5/01, 21/06, 21/28, 21/29

[56] References Cited

U.S. PATENT DOCUMENTS

| | | | |
|---|---|---|---|
| 3,747,111 | 7/1973 | Fletcher et al. | 343/725 |
| 3,761,943 | 9/1973 | Harper et al. | 343/776 |
| 4,089,003 | 5/1978 | Conroy | 343/700 MS |
| 4,138,684 | 2/1979 | Kerr | 343/846 |
| 4,141,012 | 2/1979 | Hockham et al. | 343/725 |
| 4,316,194 | 2/1982 | De Santis et al. | 343/700 MS |
| 4,400,701 | 8/1983 | Dupressoir | 343/725 |
| 4,879,563 | 11/1989 | Takeda et al. | 343/700 MS |
| 5,057,848 | 10/1991 | Rankin et al. | 343/725 |
| 5,220,334 | 6/1993 | Raguenet et al. | 343/727 |

FOREIGN PATENT DOCUMENTS

| | | | |
|---|---|---|---|
| 0188345 | 7/1986 | European Pat. Off. | H01Q 15/00 |
| 10806 | 1/1985 | Japan | 343/700 MS |

OTHER PUBLICATIONS

AP-S International Symposium, 1975, pp. 189-192, IEEE, New York, USA; W. S. Gregorwich: "A multi--polarization dual-band array" 1975.

*Primary Examiner*—Michael C. Wimer
*Attorney, Agent, or Firm*—Sughrue, Mion, Zinn, Macpeak & Seas

[57] ABSTRACT

A multifrequency radiating device comprising at least one radiating element (11) of a first type and at least one radiating element (12) of a second type, the elements being associated on a common surface (10) in order to constitute an array antenna. The radiating elements of the first type (16) are elements of the microstrip type and the elements of the second type (19, 20) are elements of the wire type, the radiating elements of the first type (16) acting in a first frequency range and the radiating elements of the second type (19, 20) acting in a second frequency range. The invention is particularly applicable to microwave antennas.

5 Claims, 4 Drawing Sheets

MULTIFREQUENCY ARRAY WITH COMPOSITE RADIATORS

This is a Continuation of application Ser. No. 07/670,514 filed Mar. 18, 1991, abandoned, which is a continuation of application Ser. No. 07/445,063 filed Dec. 4, 1989, abandoned.

REFERENCE TO RELATED APPLICATION

This application relates to application Ser. No. 07/309,760, filed Feb. 13, 1989, now U.S. Pat. No. 5,220,334, entitled "MULTIFREQUENCY ANTENNA, USEABLE IN PARTICULAR FOR SPACE TELECOMMUNICATIONS" and assigned to the common corporate assignee.

BACKGROUND OF THE INVENTION

The general trend in telecommunications satellites is towards increasing capacity in terms of power, traffic, and numbers of missions. For economic reasons, the same satellite must be capable of carrying several payloads. These make use of antenna systems of ever-increasing gain, specifically for the purpose of guaranteeing the evermore stringent parameter specifications in force, namely:

number of pencil beams;

gain over the, or each, coverage; and inter-beam isolation.

Modern payloads use antenna systems having a projected aperture lying in the range 3 meters (m) to 6 m, or more. It will readily be understood that for various reasons, in particular reasons of positioning and mass, it is not possible to multiply the number of such large antennas on the body of a single satellite.

In general, both in the case of a direct radiation array and in the case of an antenna having a reflector using a primary array, it is attractive to be able to make use of the same radiating surface: thus tending towards maximum integration of functions and better optimization of payload on-board the satellite.

The object of the invention is to provide a solution to this type of problem, thereby optimizing on a single physical surface sets of different radiating elements operating at different frequencies.

SUMMARY OF THE INVENTION

To this end, the invention provides a multifrequency radiating device comprising at least one radiating element of a first type and at least one radiating element of a second type, the elements being associated on a common surface in order to constitute an array antenna, wherein the radiating elements of the first type are elements of the microstrip type and the elements of the second type are elements of the wire type, the radiating elements of the first type acting in a first frequency range and the radiating elements of the second type acting in a second frequency range.

Advantageously, array formation can be achieved optimally for different missions at different frequencies on a single radiating antenna.

In addition, if intermediate radiating elements of the second type are used, it is possible to solve a difficult problem in forming an array of elements having fundamentally different spacing requirements due to their directivities or to their operating frequencies.

Finally, the non-interaction between the various types of radiating element makes it possible to process and optimize the overall array as though it were two independent arrays, each of which is implemented optimally:

one of the arrays using the radiating elements of the first type; and the other array using radiating elements of the second type, preferably including intermediate radiating elements.

BRIEF DESCRIPTION OF THE DRAWINGS

Embodiments of the invention are described by way of example with reference to the accompanying drawings, in which.

DETAILED DESCRIPTION

Figure 1:
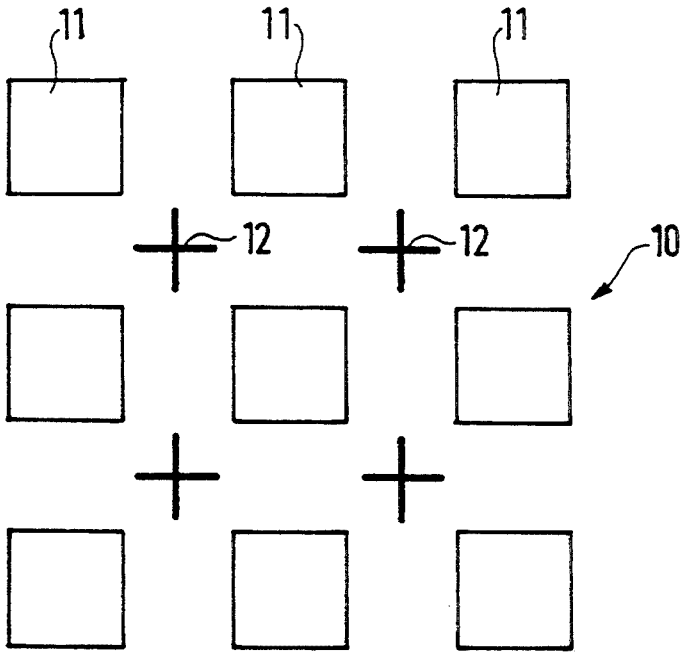
FIGS. 1 and 2 are diagrams of two embodiments of the device of the invention.

The radiating device of the invention as shown in FIG. 1 comprises at least two types of radiating element associated on a common surface 10, the radiating elements operating by different principles:

the first radiating elements 11 are of the microstrip type or the patch type; and the second radiating elements 12 are of the wire type.

A two-frequency antenna is thus obtained making it possible to provide radiation at a first frequency using a patch antenna on the same working surface as a wire antenna radiating at a second frequency. The operating impedances of these two antennas allow them to be optimized for different frequencies, with decoupling between the antennas being ensured by the fact that the principles whereby each of them radiates are different in nature.

Figure 2:
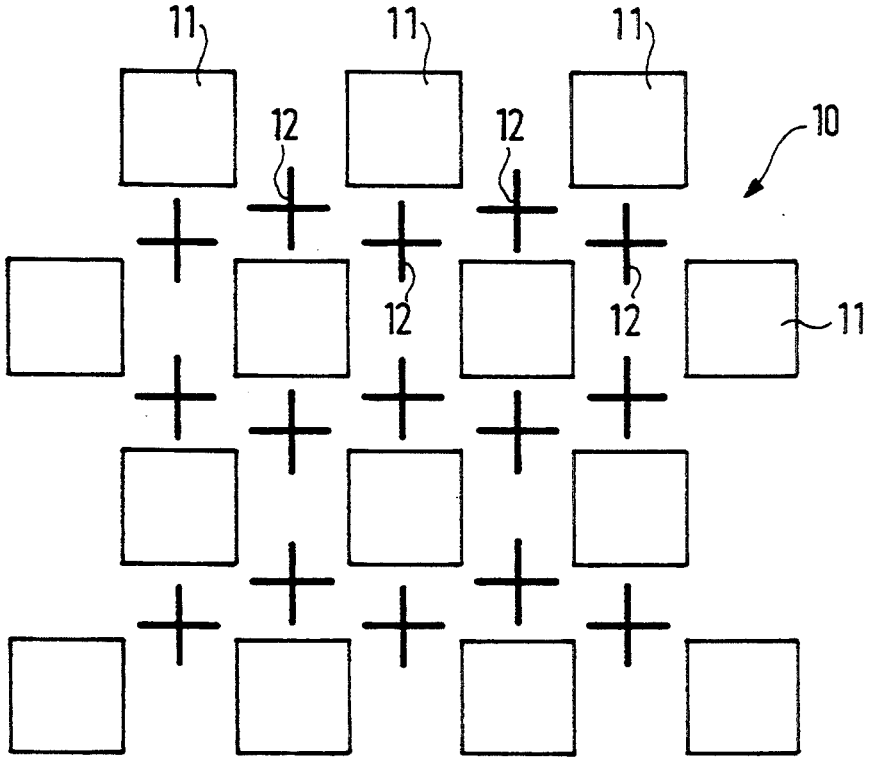

FIG. 2 shows a variant embodiment of the device of the invention in which the disposition of the first and second elements 11 and 12 is different. The number of second elements 12, e.g. of the wire type, disposed between the first elements 11, e.g. of the patch type, depends on the optimization of the antenna. The array constituted in this way may be triangular, square, rectangular, or hexagonal in type.

If such radiating elements operating by means of different principles are associated in this way on a common surface, a dual-frequency antenna is obtained. This makes it possible to use a common surface for obtaining radiation at one frequency by means of a patch antenna and radiation at another frequency by means of a wire antenna.

Such an embodiment has the following two characteristics:

the wire antenna does not have an effect on the matching and radiating characteristics of the patch antenna; and because of their different radiating principles, the coupling between the two types of element remains very low.

Various types of wire antenna may be considered for mounting on the patch antenna. The particular choice implemented depends on optimization with respect to a particular requirement, and may lead to using dipoles, single-wire helixes, four-wire helixes, . . . .

Compared with its nominal operation (i.e. without a patch antenna), there is no major change in the performance of the antenna made up of wire elements when installed on a patch antenna, with the ground plane as seen by the wire antenna being constituted by the patches and the general ground plane of the patch antenna taken together. Since the operating frequency of the wire antenna does not correspond to resonance in the patch antenna, the patch antenna does not play any special role (field concentration, cavity, resonance).

Figure 3:
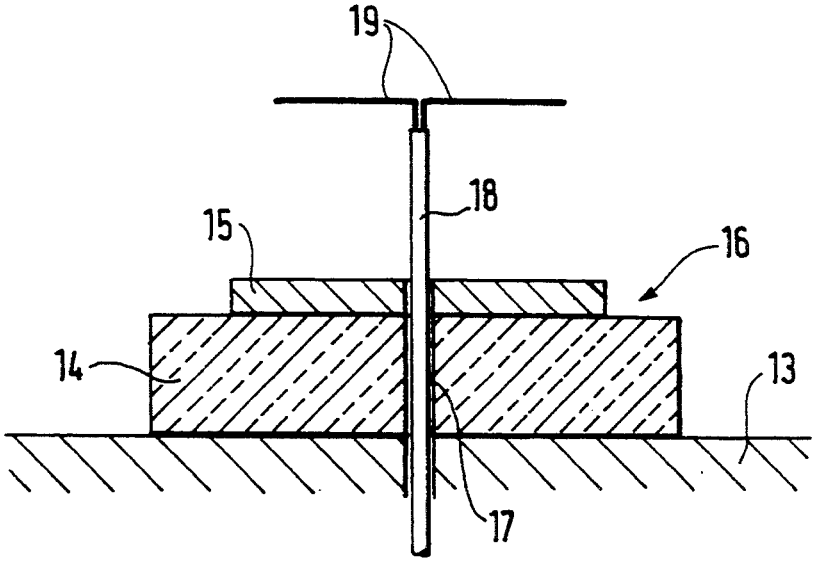
FIGS. 3 and 4 are two section views through the elements of one embodiment of the device of the invention.

In another embodiment of the device of the invention, as shown in FIG. 3, a first element 16 is associated with a second element 19 on a common projected surface in order to form a "composite" radiating element, this gives:

- a ground plane 13, a dielectric substrate 14, and a metal track 15 constituting a plane patch antenna 16, and this antenna has a through hole 17 going through the middle thereof; and
- a coaxial cable 18 passes through the hole 17 perpendicularly to the plane of the patch antenna 16, with the free end of the cable being terminated by an antenna 19 of a different type, in this case of the wire element, dipole type.

Figure 4:
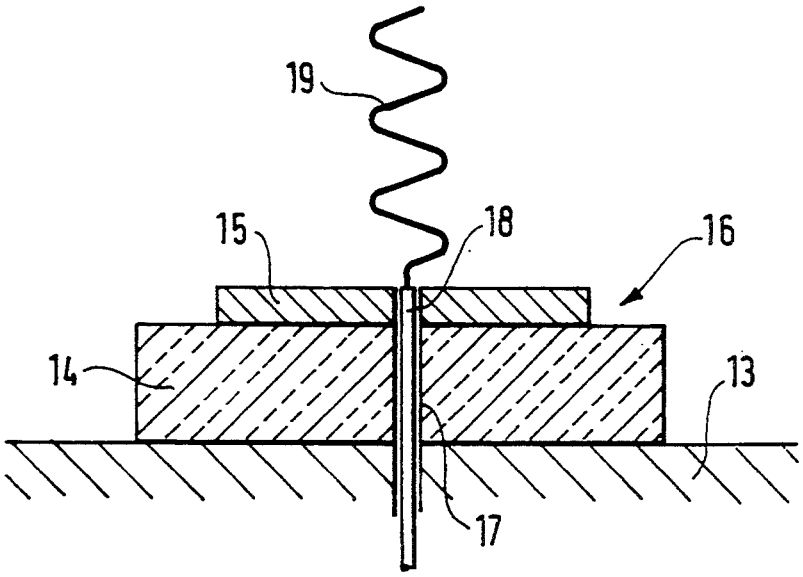

In the embodiment shown in FIG. 4, the coaxial cable 18 going through the hole 17 is terminated by an antenna 19 which is helical antenna.

The patch antenna 16 defined in this way is sized in such a manner as to meet the general requirements of its mission. Depending on circumstances as a function of the particular application, it may consist, for example:

- in a single resonator patch element;
- in a two-resonator patch element; or
- in a diplexing double patch element having separate accesses for two frequency ranges, e.g. a transmission access and a reception access.

The wire element 19 is defined as a function of requirements specific to its own mission. Its shape (be that dipole or helical) is optimized in order to obtain the desired performance.

Figure 5:
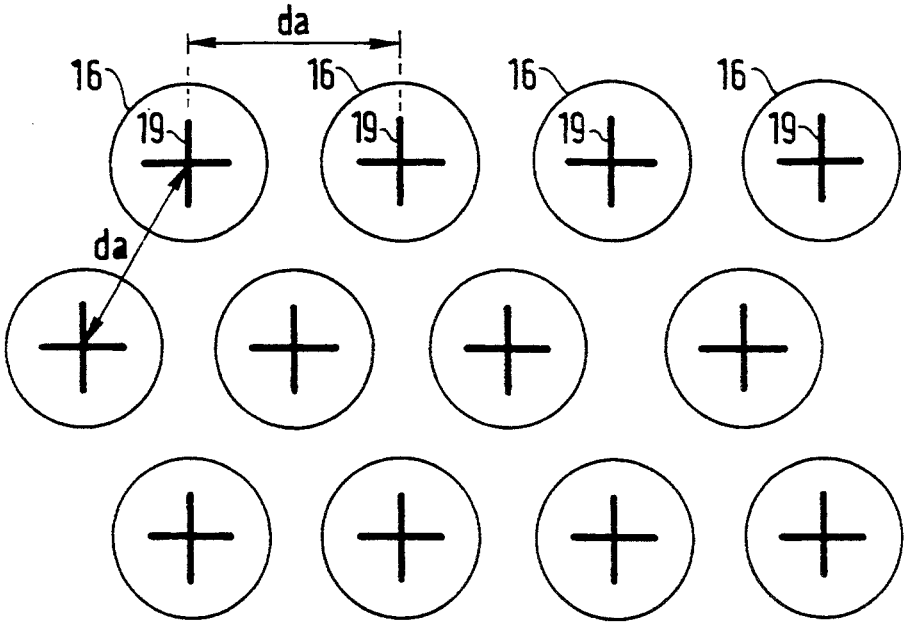
FIGS. 5 to 7 are diagrams of three embodiments of the device of the invention.

An array antenna can thus be built up from composite radiating elements as described above. However, such an array is built up only from elements as described gives rise to serious efficiency and simultaneous optimization problems with respect to the various different missions, and may be difficult or even impossible to solve. Thus, the antenna shown in FIG. 5 comprises single resonator patch elements 16 for performing a mission at 1.5 GHz, for example. This type of antenna typically has a directivity of about 7 dB to 8 dB, and a knowledge of mutual coupling makes it possible to expect satisfactory utilization, i.e. at more than 80% efficiency compared with the area of the elementary cell. These elements are then situated:

at a distance of about $da=0.67\ \lambda_{0L}$ for a square lattice or at a distance of 0.70 to 0.72 $\lambda_{0L}$ for a hexagonal lattice;

where $\lambda_{0L}$ is the wavelength of the center frequency of the first frequency range, e.g. in the L band (1.5 GHz to 1.6 GHz).

These operating constraints on the first radiating elements 16 (optimum coupling/spacing) frees the inter-patch spacing da and thus the general disposition of the array.

If it is desired to accomplish a mission at 2.00 GHz using second radiating elements 19 as described above, dipoles 19 are placed on the patches 16. Typically the dipoles give a directivity of 5.20 dB.

This directivity requires an array of identical elements to be formed at the following spacing:

about 0.51 $\lambda_{0S}$ for a square lattice; or about 0.55 $\lambda_{0S}$ for a hexagonal lattice;

where $\lambda_{0S}$ is the center wavelength of the second frequency range, e.g. the S band (2 GHz). Since the available positions are nominally locked to the inter-patch distances, the actual geometry of the configuration under consideration would give inter-dipole distances da of:

0.89 $\lambda_{0S}$ (band S) for a square lattice; or 0.96 $\lambda_{0S}$ for a hexagonal lattice.

This is equivalent to a loss of about 4 dB to 5 dB for S band dipole elements 19 due to the way the array is formed, i.e. too highly constrained by the positions of the array of patch elements.

The solution to this under sampling of the S band elements consists in using intermediate elements 20 of the same type as the second elements, said intermediate elements also radiating in the second frequency band, and being placed between the patches.

The intermediate elements 20 can be put into place because the field densities from the patch elements are negligible in the zones under consideration. Measurements performed for various different positioning distances have confirmed these results and have shown that these additional elements have little effect on the nominal operation of the composite dual-waveband elements 16–19.

Figure 6:
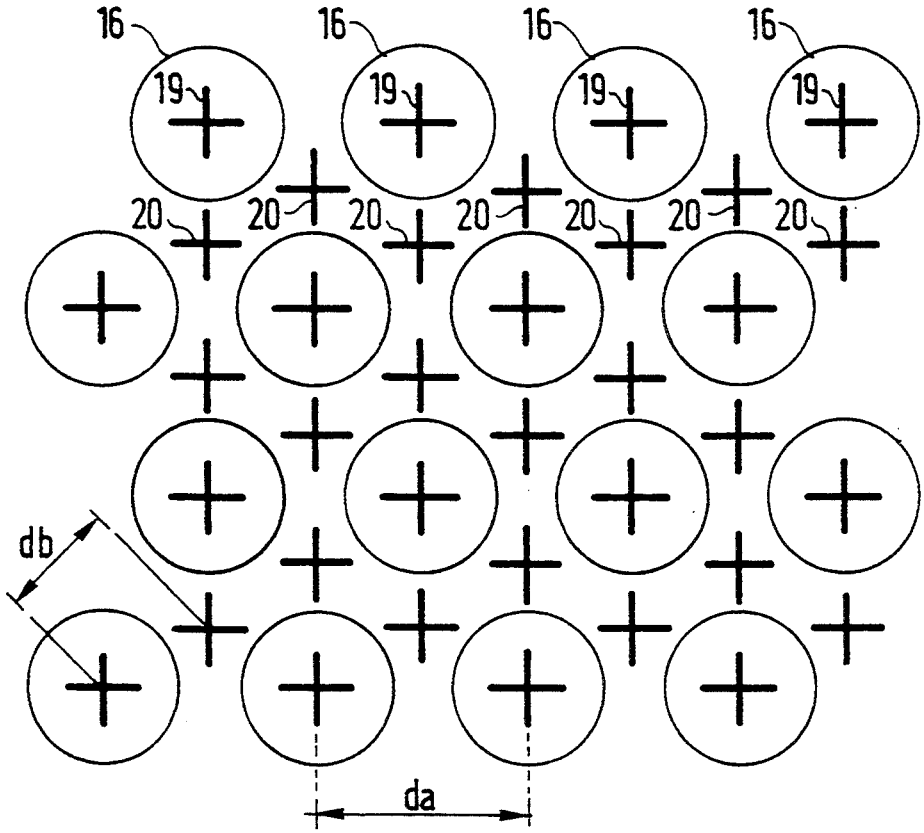

Such a configuration, as shown in FIG. 6, thus makes it possible to considerably increase the density of the array of second radiating elements 19 so that its sampling is greatly improved, without having any significant impact on the first radiating elements 16.

In a hexagonal lattice as shown in FIG. 6, the resulting inter dipole distances including both the elements 19 and 20 correspond to $db=da/\sqrt{3}$, i.e. typically for a hexagonal lattice to $db=0.96\ \lambda_{0S}/\sqrt{3}$, i.e. $db=0.55\ \lambda_{0S}$. This distance therefore corresponds to optimum sampling for use of the dipoles in the S band. Making an S band array by means of the elements 19 and 20 thus makes it possible to obtain maximum efficiency from the available area and corresponds to an optimum array disposition for the S band elements on their own.

This result is also immediately clear from an argument based on directivity. With a lattice of this type, a second radiating element 19 is surrounded by six intermediate radiating element 20. Each of these elements 20 is shared between three second elements 19, so that with respect to a hexagonal lattice it appears as though all three of these second elements 19 are contributing to the radiation from a cell. The cell in question has an are S such that $S=\frac{1}{2}\sqrt{3}(0.96\ \lambda_{0S})^2$, i.e. $S=0.798\ \lambda_{0S}^2$.

The maximum directivity DM of such a cell is given by $DM=4S/\lambda_{0S}^2$, i.e. DM=10 dB.

The association of three 5.2 dB radiating elements 19 in amplitude and phase corresponds to a directivity pattern:

$$\tau_{array}=N+\tau_{element}=10\text{ dB}$$

where all units are in dB (N=3, and 10.log(3)=4.8).

A multifrequency array antenna can thus be made optimal for various missions by using:

- firstly composite radiating elements as shown in FIGS. 3 and 4; and
- secondly additional elements 20 placed between the composite radiating elements.

Figure 7:
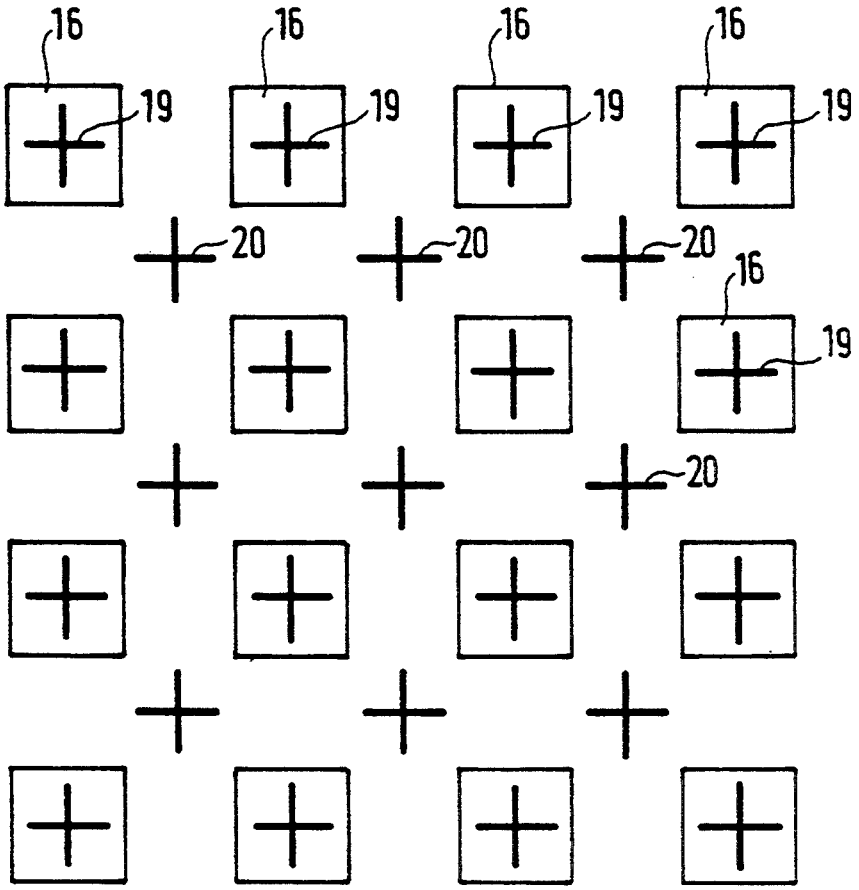

FIG. 6 shows how these elements are placed in a hexagonal lattice, while FIG. 7 gives an example of a square lattice.

The array can thus be formed optimally for various different missions at different frequencies and using the same radiating antenna.

The possibility of using intermediate radiating elements 20 thus makes it possible to solve the difficult problem of forming an array of elements having fundamentally different spacing requirements due to their directivities or to their operating frequencies.

The non-interaction between the different type of radiating element makes it possible to treat and optimize the overall array as though it were two independent arrays, with each of them being formed optimally:

one making use of the first radiating elements 16; and the other using both the second radiating elements 19 and the intermediate elements 20.

Naturally the present invention has been described and shown merely by way of preferred example and its component parts could be replaced by equivalent parts without thereby going beyond the scope of the invention.

Thus, the shape of the radiating device of the invention could naturally be other than plane, and it could be curved to some extent (cylindrically, spherically, . . . ), depending on the particular position in which it is installed on a structure: e.g. on a concave surface.

We claim:

1. A multifrequency radiating array antenna comprising:

a surface forming a ground plane;

a plurality of radiating elements of a first type, radiating at a first frequency according to a first type of radiation;

a plurality of radiating elements of a second type, radiating at a second frequency according to a second type of radiation;

wherein said radiating elements of said first type are microstrip patch radiating elements, said microstrip patch radiating elements comprising a dielectric substrate, and a metallic patch placed on a surface of said dielectric substrate, said dielectric substrate being placed on said ground plane, this disposition forming an antenna, and said first type of radiation is that furnished by a microstrip patch radiating element;

wherein said radiating elements of said second type are wire radiating elements, said wire radiating elements comprising a wire element disposed above said ground plane forming an antenna, and said second type of radiation is that furnished by a wire type radiating element;

wherein said ground plane is a common ground plane for all said radiating elements of said first type and for all said radiating elements of said second type, such that only one ground plane surface is necessary for said multifrequency radiating array, and when said radiating array is disposed on said ground plane surface;

and wherein said first and said second type radiating elements are associated to form composite elements, each composite element comprising:

a said radiating element of said first type;

a said radiating element of said second type; and wherein said radiating element of said first type has a hole passing through the middle thereof;

said composite element further comprising a coaxial cable passing through said hole perpendicular to said ground plane, and said coaxial cable having a free end terminated by a said wire radiating element of said radiating element of said second type.

2. A device according to claim 1, further comprising intermediate radiating elements placed between the composite radiating elements; said intermediate radiating elements being of the same type as the second type radiating elements and radiating at the second frequency.

3. A device according to claim 2, wherein said composite elements and said intermediate radiating elements constitute a hexagonal lattice array in which a second type radiating element forming part of a composite element is surrounded by six intermediate radiating elements.

4. A device according to claim 2, wherein said composite elements and said intermediate radiating elements constitute a square lattice array in which a second type radiating element forming part of a composite element is surrounded by four intermediate radiating elements.

5. A device according to claim 1, wherein the first and second frequencies are of the L frequency band and the S frequency band, respectively.

* * * * *